US006042352A

United States Patent [19]

Halter et al.

[11] Patent Number: 6,042,352

[45] Date of Patent: Mar. 28, 2000

[54] BEARING WITH PULSED BLEED CONFIGURATION

[75] Inventors: Jeffrey A. Halter, Chardon; David J. Horvath; Nick J. Popovich, both of Euclid, all of Ohio

[73] Assignee: Argo-Tech Corporation, Cleveland, Ohio

[21] Appl. No.: 09/132,924

[22] Filed: Aug. 12, 1998

[51] Int. Cl.[7] ..... F01C 21/00

[52] U.S. Cl. ..... 418/189; 418/132; 418/180

[58] Field of Search ..... 418/180, 132, 418/189

[56] References Cited

U.S. PATENT DOCUMENTS

| | | | |
|---|---|---|---|
| 1,252,160 | 1/1918 | Pagel | 418/189 |
| 2,774,309 | 12/1956 | Stoyke et al. | 418/180 |
| 2,981,200 | 4/1961 | Stephens | 418/180 |
| 3,003,426 | 10/1961 | Lauck | 418/180 |
| 3,175,505 | 3/1965 | Soltau | 418/186 |
| 3,276,387 | 10/1966 | Bottoms | 418/170 |
| 3,291,060 | 12/1966 | Bottoms | 418/170 |
| 3,429,625 | 2/1969 | Stott . | |
| 3,431,862 | 3/1969 | Bottoms | 418/180 |
| 3,439,625 | 4/1969 | Warne | 418/190 |
| 3,457,872 | 7/1969 | Potts | 418/137 |
| 3,476,055 | 11/1969 | Crowther | 418/132 |
| 3,498,185 | 3/1970 | Warne | 418/270 |
| 3,597,129 | 8/1971 | Crowther | 418/126 |
| 3,653,796 | 4/1972 | Kercher et al. | 431/328 |
| 3,752,608 | 8/1973 | Knowles et al. | 418/131 |
| 3,765,807 | 10/1973 | Joyce | 418/191 |
| 3,833,317 | 9/1974 | Rumsey | 418/189 |
| 3,869,224 | 3/1975 | Brinkman | 417/383 |
| 4,017,224 | 4/1977 | Jons | 418/189 |
| 4,097,206 | 6/1978 | Schonherr | 418/78 |
| 4,108,582 | 8/1978 | Bitton | 418/132 |
| 4,130,383 | 12/1978 | Moinuddin | 418/189 |
| 4,193,745 | 3/1980 | Hamilton et al. | 418/9 |
| 4,281,974 | 8/1981 | Teruyama | 418/132 |
| 4,290,739 | 9/1981 | Korse | 418/189 |
| 4,386,893 | 6/1983 | Hauser, Jr. | 418/191 |
| 4,493,188 | 1/1985 | Marsh | 418/191 |
| 4,519,417 | 5/1985 | Spencer | 137/501 |
| 4,560,333 | 12/1985 | Fujiwara et al. | 418/180 |
| 5,118,268 | 6/1992 | Crisenbery et al. | 418/189 |
| 5,246,358 | 9/1993 | Gu | 418/189 |
| 5,674,060 | 10/1997 | Buchmuller | 418/132 |

FOREIGN PATENT DOCUMENTS

| | | | |
|---|---|---|---|
| 2623357 A1 | 12/1977 | Germany | 418/189 |
| 0131388 | 8/1983 | Japan | 418/189 |
| 968998 | 10/1960 | United Kingdom | 418/189 |

*Primary Examiner*—Thomas Denion
*Assistant Examiner*—Theresa Trieu
*Attorney, Agent, or Firm*—Fay, Sharpe, Fagan, Minnich & McKee, LLP

[57] ABSTRACT

A bearing for a gear pump including a bearing dam which has a surface, an inlet face relief located on the bearing dam, and a discharge face relief located on the bearing dam. A bearing dam wall is located between the inlet face relief and the discharge face relief and a bleed hole arrangement. The bleed hole arrangement includes a blind passage located on the discharge face relief, and a second passage positioned perpendicular to and connected to the blind passage. The second passage extends to the surface of the bearing dam. In an alternative embodiment, the second passage is of a stepped configuration. The bleed hole arrangement reduces cavitation on the bearing and gear surfaces by pulsing fuel into an inter-tooth volume formed between the gear teeth during gear rotation. The fuel is pulsed into the inter-tooth volume so as to introduce a small amount of fluid to reduce fluid accelerations and, hence, minimizing the formation of vapor cavities within the volume thus minimizing the amount of cavitation erosion on the gear teeth and bearing dams.

5 Claims, 5 Drawing Sheets

BEARING WITH PULSED BLEED CONFIGURATION

BACKGROUND OF THE INVENTION

The present invention relates generally to bearings for gear pumps. More particularly, it relates to an improved bearing with a pulsed bleed hole configuration with intent to minimize cavitation damage.

Gear pumps often comprise two gears, usually of similar configuration, that mesh with each other inside a housing. A first or drive gear is an extension of a drive shaft; as it rotates, it drives a second gear, commonly called the driven gear. As the gears rotate within the housing, fluid is transferred from an inlet to an outlet of the pump. The drive gear must carry the full power load of the pump. The gears are highly stressed at high pressures and high loads. Gears of either spur or helical configuration can be used; although spur gears are most common.

The volume of fluid pumped through a gear pump partially depends on the depth of the tooth, the tooth count, and the width of the gear. Larger volumetric output is realized when lower gear tooth counts with large working tooth depths and face width are used. Most pumps have gears with ten or twelve teeth.

As a spur gear rotates, individual "segments" of fluid are released between the teeth to the outlet, thereby pulsing or rippling the output flow.

A problem that occurs with larger gear pumps operated at high speeds is cavitation erosion of the surfaces of the gear teeth and/or bearings. Cavitation erosion results in pitting of the surfaces of the gear teeth and bearings that eventually can result in degraded pump volumetric capacity and affect pump durability. As the gears rotate and go through their mesh cycle, an opening inter-tooth volume is formed. As the volume increases in size from minimum to maximum, the pressure within this volume decreases and vapor bubbles or cavities are formed. As the gears rotate and the volume is further filled, this volume is subjected to higher pressure. As a result, the vapor formed within the inter-tooth volume is forced back into solution. The energy associated with this change of phase is significant and, in effect, the vapor cavity implodes on the gear teeth and bearing surfaces thus resulting in cavitation damage to these surfaces.

Existing gear pump designs are known in the art, including the following: U.S. Pat. Nos. 4,097,206; 4,193,745; 3,003,426; 2,981,200; and 2,774,309.

Accordingly, it has been considered desirable to develop a new and improved bearing with a pulsed bleed hole configuration which would overcome the foregoing difficulties and others while providing better and more advantageous overall results in a simple manner.

BRIEF SUMMARY OF THE INVENTION

The present invention relates to a bearing with a stepped or non-stepped pulse bleed configuration.

More particularly, the present invention is directed toward an aircraft main engine gear-type fuel pump with a stepped or non-stepped bleed configuration bearing which overcomes the drawbacks associated with prior art arrangements.

In the preferred embodiment, a bearing for a gear pump comprises a bearing dam including a surface having an inlet face relief located on the bearing dam, a discharge face relief located on the bearing dam at an area spaced from the inlet face relief, and a bearing dam wall located between the inlet face relief and the discharge face relief. A bleed hole arrangement on the bearing dam includes a blind passage located on the discharge face relief, and a second passage positioned perpendicular to and connected to the blind passage. The second hole extends to the surface of the bearing dam. If preferred, the second passage is of a smaller diameter than the blind passage.

In another preferred embodiment of the present invention, the bleed hole arrangement for the bearing dam includes a blind passage located on the discharge face relief, and a second stepped passage comprising a top opening and a bottom opening. The top opening is of a larger diameter than the bottom opening. The top opening is coaxial to and positioned above the bottom opening. The bottom opening is positioned perpendicular to and connected to the blind passage. The top opening extends to the surface of the bearing dam.

In another preferred embodiment, an aircraft gear pump assembly comprises a pair of bearing dams, each bearing dam comprising an inlet face relief located on a surface of the bearing dam, a discharge face relief located on the bearing dam at an area spaced from the inlet face relief, and a bearing dam wall located between the inlet face relief and the discharge face relief. A bleed hole arrangement includes a blind passage located on the discharge face relief, and a second passage positioned perpendicular to and connected to the blind passage. The second passage is of a smaller diameter than the blind passage and extends to the surface of the bearing dam. The pair of bearing dam walls abut each other to form a seal between an inlet side and a discharge side of the gear pump. A pair of rotating gears are spaced apart from the pair of bearing dams. The gears include teeth which mesh during rotation. An inter-tooth volume forms between the teeth and the bearing dams during rotation. The teeth periodically cover and uncover the bleed hole during rotation resulting in pulsing of fluid out of the bleed hole into the inter-tooth volume.

If preferred, the second passage is stepped with a top opening and a bottom opening. The top opening is of a larger diameter than the bottom opening. The top opening is coaxial to and positioned above the bottom opening. The bottom opening is positioned perpendicular to and connected to the blind passage. The top opening extends to the surface of the bearing dam.

One advantage of the present invention is the provision of a bleed hole arrangement in a bearing for a gear pump to reduce cavitation.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
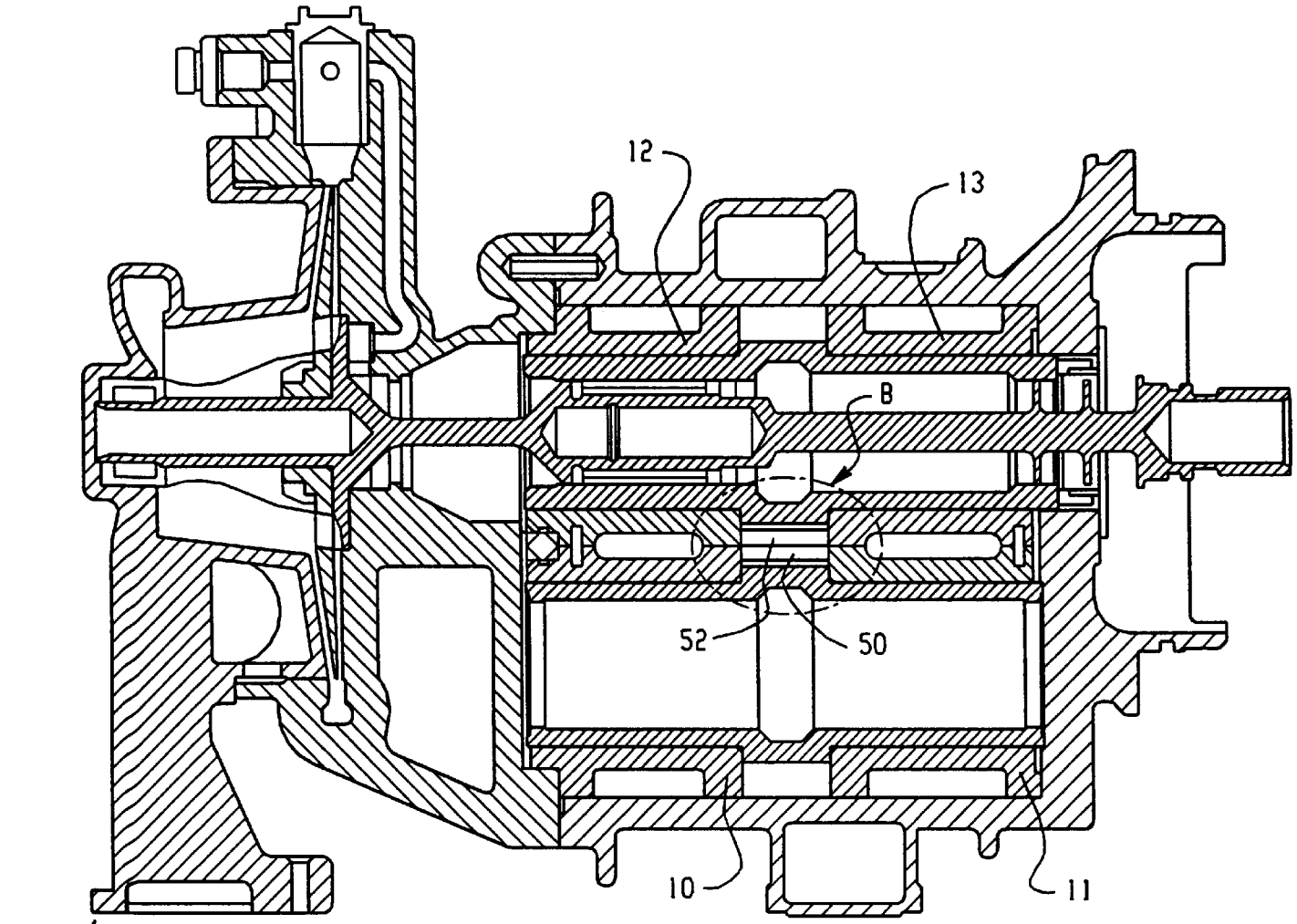
FIG. 1 is a side elevational view in cross section of an aircraft engine fuel pump with a bearing and gear arrangement in accordance with a preferred embodiment of the present invention.
Figure 2:
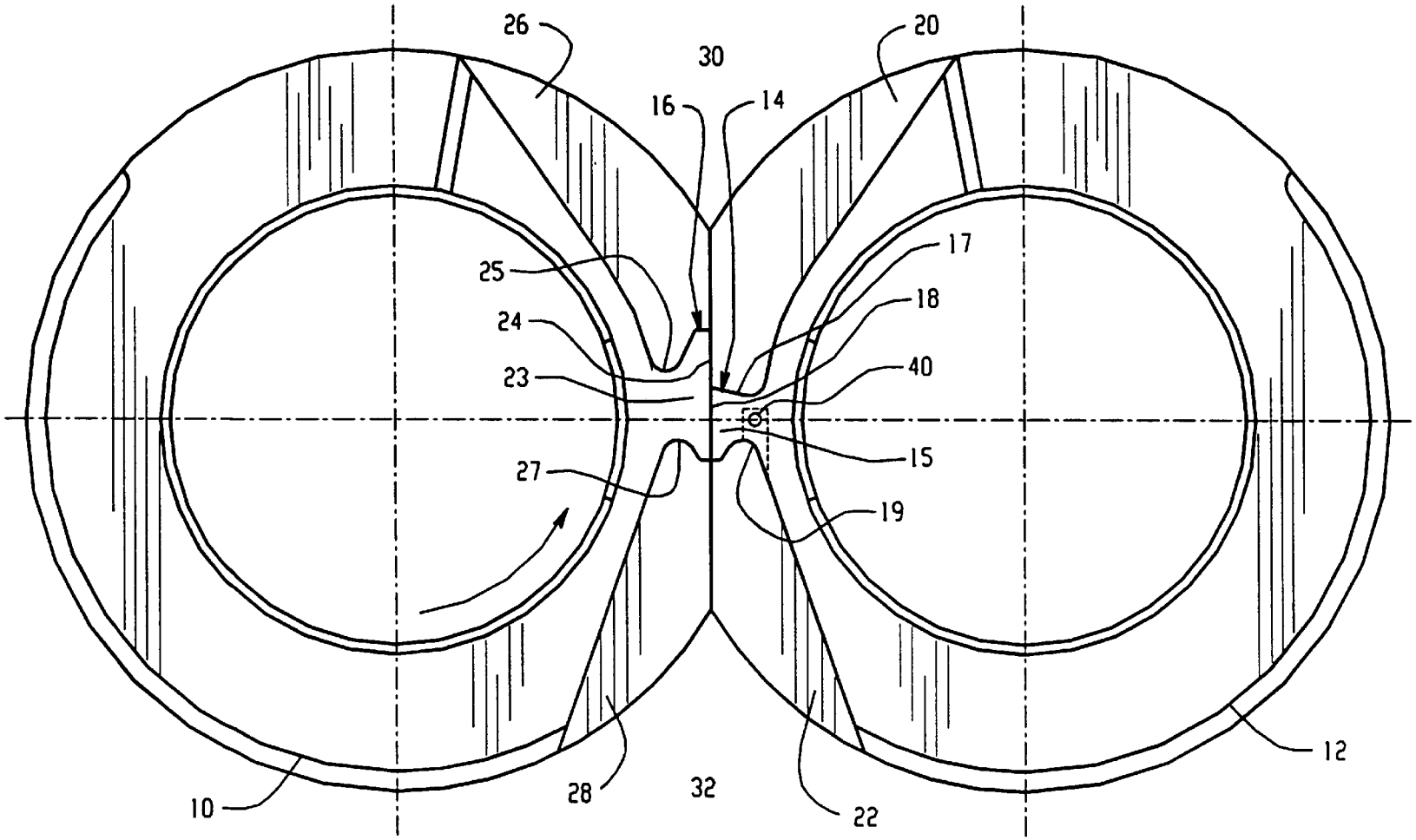
FIG. 2 is an enlarged top elevational view of the bearing and gear arrangement in accordance with the first preferred embodiment of the present invention.

Referring now to the drawings, wherein the showings are for purposed of illustrating a preferred embodiment of this invention only and not for purposes of limiting same, FIG. 1 shows a main engine fuel pump A with a bearing and gear configuration B in accordance with a preferred embodiment of the present invention. FIG. 2 shows a pair of bearings 10 and 12 which abut at the surfaces of the bearing dams 14 and 16. Referring to FIG. 1, a second pair of bearings 11 and 13, which are spaced apart from bearings 10 and 12, are similarly positioned with respect to one another.

Figure 3:
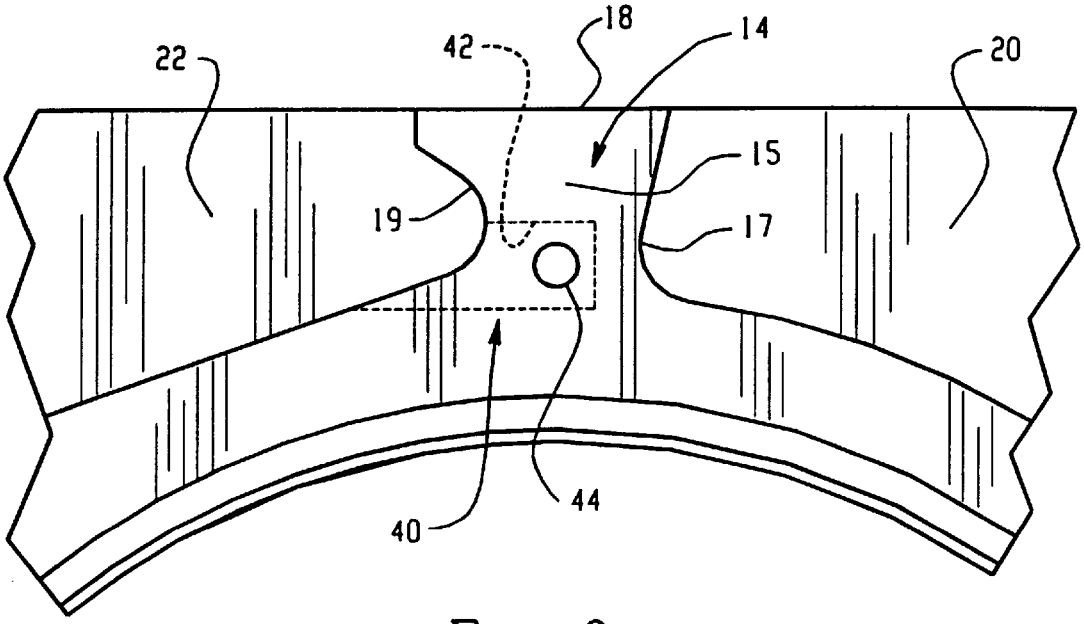
FIG. 3 is an enlarged top elevational view of pulsed bleed hole arrangement in accordance with a first preferred embodiment of the present invention.

Referring now to FIGS. 2 and 3, the dam 14 includes a first or top surface 15 which terminates in a first end 17, a second end 19, and a bearing dam wall 18. An inlet face relief 20 is located on the first end 17 and the discharge face relief 22 is located on the second end 19 of the dam 14. Thus, the bearing dam wall 18 is located between the inlet face relief 20 and the discharge face relief 22.

The mating bearing area 16 (FIG. 2) includes a first or top surface 23, which similarly terminates in a first end 25, a second end 27, and a bearing dam wall 24. An inlet face relief 26 is likewise located on the first end 25 of the dam 16 and a discharge face relief 28 is located on the second end 27 of the dam 16. The bearing dam wall 24 is located between the inlet face relief 26 and the discharge face relief 28.

The bearing dam walls 18 and 24 abut each other to form a sealed dam area between an inlet side 30 and an outlet side 32, thus resulting in a low-pressure area on the inlet side 30 and high-pressure area on the outlet side 32 of the pump.

Figure 6:
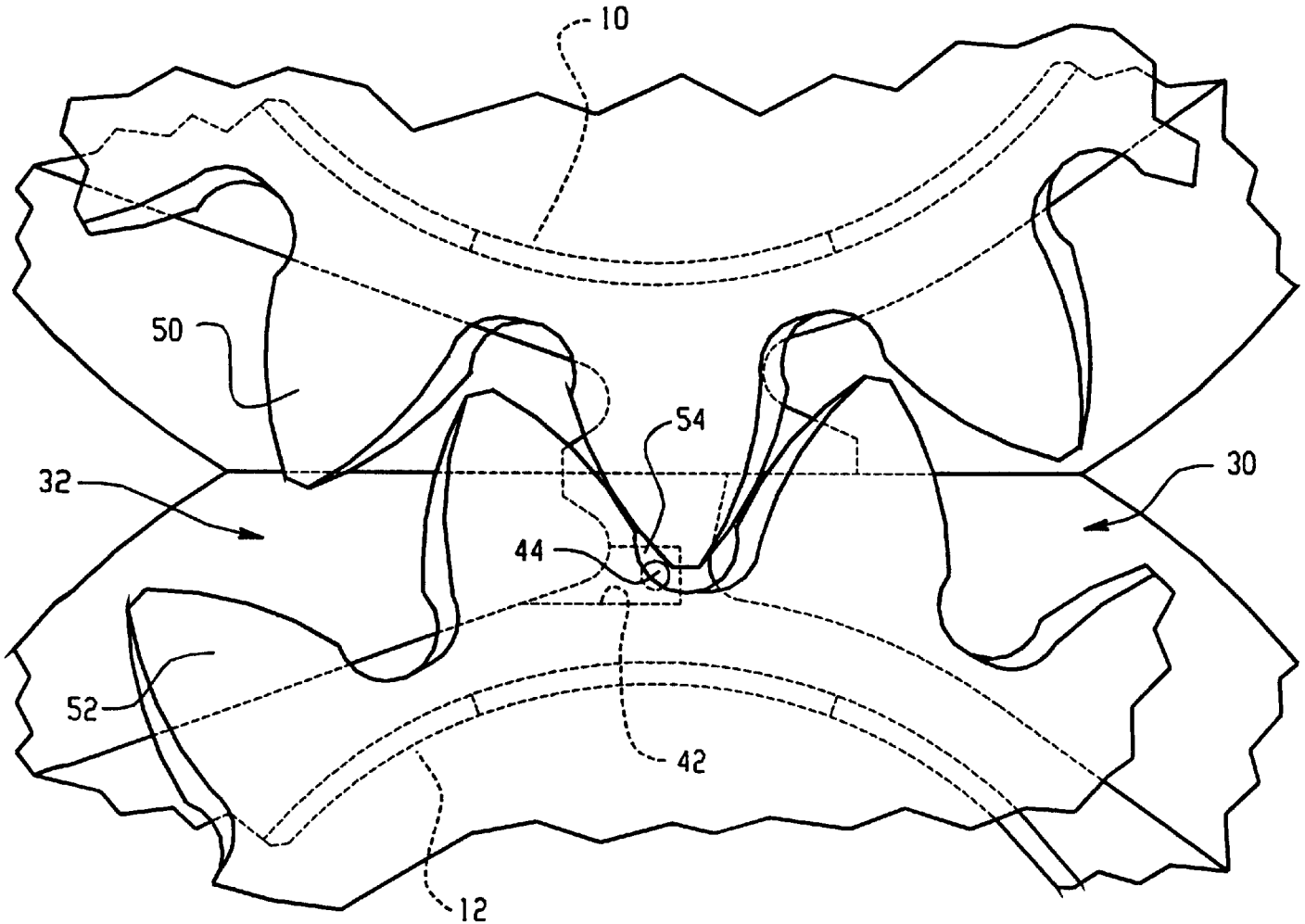
FIG. 6 is a top elevational view of the gear and bearing arrangement and non-stepped hole in accordance with the first preferred embodiment of the present invention.

Pressurization occurs when fuel moves from the low pressure inlet side of the bearing to the high pressure discharge side of the bearing. Gears 50, 52 are longitudinally sandwiched between the bearings 10 and 11 and 12 and 13 as shown in FIGS. 1 and 6. As the gears 50, 52 rotate about respective, parallel axes, the gears mesh together. Fluid is thus moved from the inlet side 30 of the bearings around the outside of the gears 50, 52 to the outlet side in a manner well known in the art.

Referring now to FIG. 6, an inter-tooth volume 54 is formed between the gear teeth. As the inter-tooth volume 54 increases, the pressure within the inter-tooth volume 54 drops below the true vapor pressure of the fluid and vapor cavities form within the inter-tooth volume 54. If the vapor is allowed to form and stay within the inter-tooth volume 54, then the vapor will eventually implode and result in cavitation erosion on the surfaces of the gear teeth and bearings.

Figure 4:
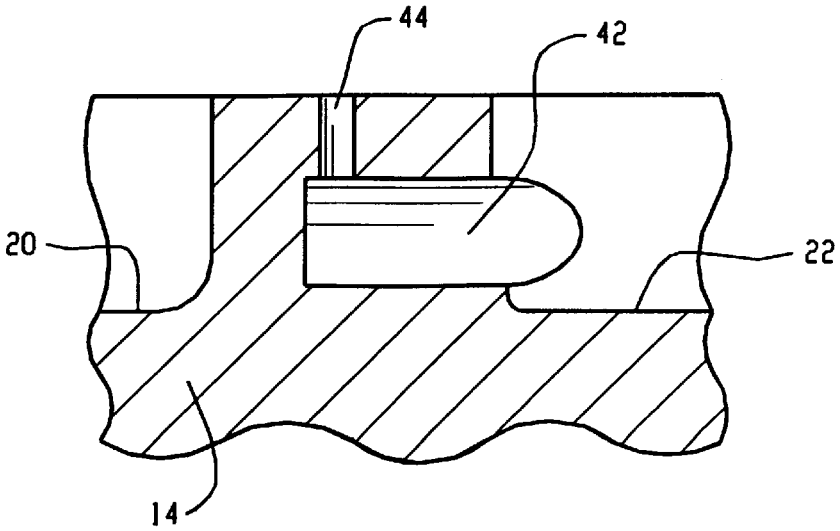
FIG. 4 is a side elevational view in cross-section of the pulsed bleed hole arrangement in accordance with the first preferred embodiment of the present invention.
Figure 5:
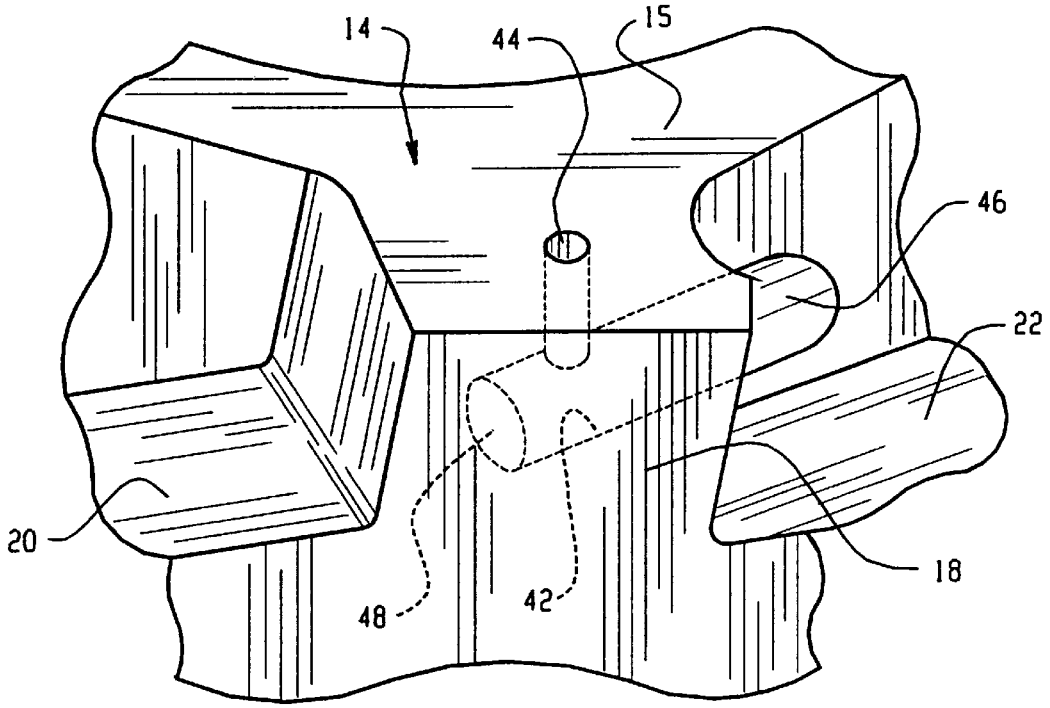
FIG. 5 is an enlarged perspective view of the non-stepped pulsed bleed hole arrangement in accordance with the first preferred embodiment of the present invention.

To prevent this cavitation, a bleed hole arrangement 40 is added to the bearing dam 14 to prevent vapor cavity formation and subsequent cavitation damage. Referring to FIG. 3, the bleed hole arrangement 40 is shown in the bearing dam area 14. The preferred bleed hole arrangement 40 includes a pair of passages, openings or holes 42, 44 which are perpendicular and connected to each other. Blind hole 42 is located on the discharge face relief 22 and extends inwardly therefrom. The passage is positioned parallel to the bearing face. The second hole 44 is preferably of smaller diameter. As perhaps better viewed in FIGS. 4 and 5, the opening 44 is perpendicular to the blind hole 42 and extends to the top surface 15 of the bearing dam 14. As apparent from these Figures, the opening 44 has a substantially constant diameter along its length and extends in linear fashion so that it intersects the dam area 14 in substantially perpendicular fashion. Passage 42 is illustrated as having a larger diameter than passage 44 and also preferably has a constant diameter along its length, communicating with the discharge face relief 22 at a first end 46 and defining a blind end 48 opposite the first end 46. As will also be appreciated, the passage 44 intersects passage 42 adjacent the blind end 48.

Referring now to FIG. 6, as the gears mesh, they form a seal between the low pressure area or inlet area 30 and the high pressure area or discharge area 32. The rapid expansion of the inter-tooth volume 54 during the tooth mesh cycle creates low pressure within the inter-tooth volume 54. The pulse bleed hole 44 adds a small amount of fluid into the inter-tooth volume 54, thus reducing fluid acceleration and, hence, minimizing the formulation of vapor cavities within the inter-tooth volume 54. As the gears rotate, they periodically cover and uncover the second hole 44, thus resulting in a pulsing action of the fluid out of the second hole 44 into the inter-tooth volume 54, i.e., a pulsed bleed bearing configuration.

Figure 7:
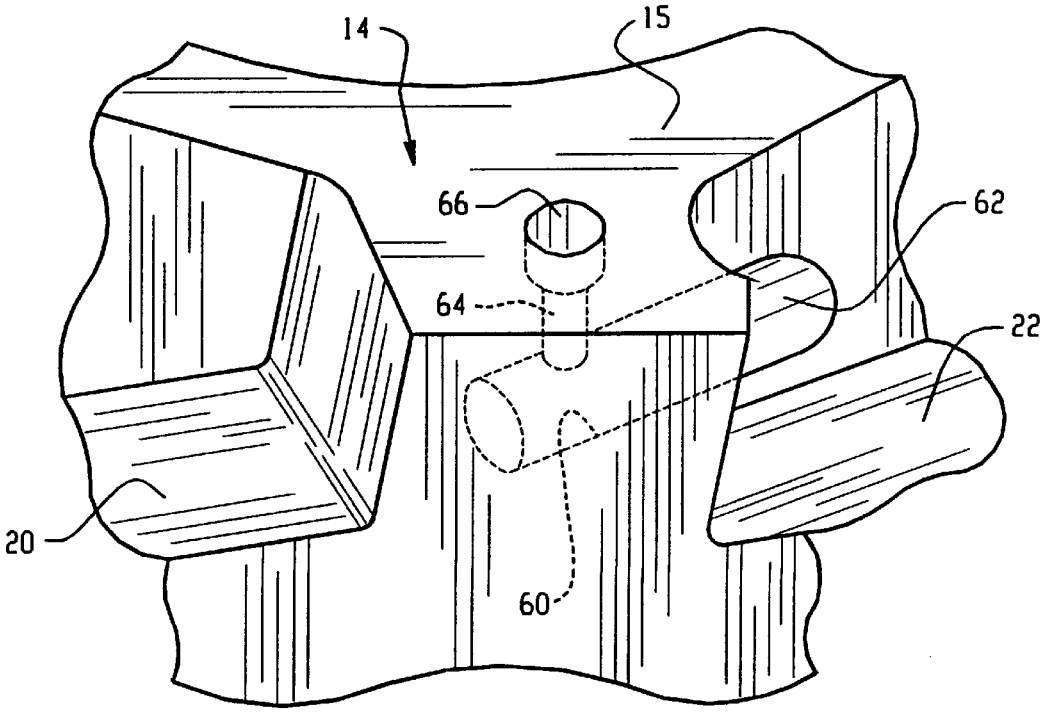
FIG. 7 is an enlarged perspective view of the stepped bleed hole arrangement in accordance with a second preferred embodiment of the present invention.

In an alternative embodiment, a stepped hole arrangement 60 can be used as shown in FIG. 7. A blind hole 62 is added to the discharge face relief 22 of the bearing dam 14. A narrow diameter second hole 44 is connected to and perpendicular to the blind hole 62 and is used to control the amount of fluid flowing out of the hole. Pump efficiency is reduced if too much fluid flows through the hole 64. A larger hole 66 which extends to the top surface 15 of the bearing dam 14 is added to increase the time in which the opening is exposed during gear rotation and allow fluid to flow into the inter-tooth volume 54. However, with this stepped hole configuration, some cavitation was found to occur around the area of the hole.

In the invention disclosed herein, an opening, small passage, or hole is added to the bearing and located so as to introduce a small amount of fluid from the high pressure zone of the bearing to the opening gear tooth volume, reducing required fluid accelerations and, hence, minimizing the formulation of vapor cavities during the tooth mesh cycle. The pulsed bleeding occurs because, as the gears rotate, they periodically cover and uncover the hole, thus resulting in pulsing of the fluid out of the hole and into the inter-tooth volume during gear mesh.

A stepped hole arrangement was first introduced where a small diameter hole was used to control the amount of fluid flowing out of the holes. However, with the stepped hole configuration, some cavitation was found to occur around the expansion area of the smaller hole leading into the second larger hole.

A non-stepped hole arrangement was then used which appeared to completely eliminate any cavitation at the hole area or on the bearing dam or gear teeth.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the present invention, it is now claimed:

1. A bearing for a gear pump comprising:

a bearing dam including a surface having an inlet face relief located on said bearing dam;

a discharge face relief located on the bearing dam at an area spaced from the inlet face relief;

a bearing dam wall located between the inlet face relief and the discharge face relief;

a bleed hole arrangement including a blind passage located on the discharge face relief, and a second passage positioned substantially perpendicular to and connected to the blind passage, the second hole extending to the surface of the bearing dam.

2. The gear pump assembly of claim 1 wherein the second passage is of a smaller diameter than the blind passage.

3. The gear pump assembly of claim 1, wherein the second passage of the bleed hole arrangement is of a stepped configuration with a top opening and a bottom opening wherein the top opening is of a larger diameter than the bottom opening, the top opening is coaxial to and positioned above the bottom opening, the top opening extends to the surface of the bearing dam, the bottom opening is connected and perpendicular to the blind passage.

4. An aircraft gear pump assembly comprising:

a pair of bearing dams, each bearing dam comprising:

an inlet face relief located on a surface of the bearing dam;

a discharge face relief located on the bearing dam at an area spaced from the inlet face relief;

a bearing dam wall located between the inlet face relief and the discharge face relief;

a bleed hole arrangement including a blind passage located on the discharge face relief, and a second passage positioned perpendicular to and connected to the blind passage, the second passage being of a smaller diameter than the blind passage and extending to the surface of the bearing dam;

the pair of bearing dam walls abutting each other to form a seal between an inlet side and a discharge side of the gear pump; and a pair of rotating gears spaced apart from the pair of bearing dams, the gears including teeth which mesh during gear rotation and flow of fluid over the gears and bearings, the teeth forming an inter-tooth volume between the teeth and the bearings during rotation and periodically covering and uncovering the bleed hole during rotation resulting in pulsing of fluid out of the bleed hole into the inter-tooth volume.

5. The gear pump assembly of claim 4, wherein the second passage of the bleed hole arrangement is of a stepped configuration with a top opening and a bottom opening, the top opening is of a larger diameter than the bottom opening, the top opening is coaxial to and positioned above the bottom opening, the top opening extends to the surface of the bearing dam, the bottom opening is connected and perpendicular to the blind passage.

* * * * *